US006729554B2

(12) United States Patent
Katsura et al.

(10) Patent No.: US 6,729,554 B2
(45) Date of Patent: May 4, 2004

(54) STRUCTURE OF FUEL INJECTOR FOR AVOIDING INJECTION OF EXCESS QUANTITY OF FUEL

(75) Inventors: Ryo Katsura, Kariya (JP); Kenji Funai, Kariya (JP); Toshihiko Igashira, Toyokawa (JP); Satoshi Hayashi, Kuwana (JP)

(73) Assignee: Denso Corporation (JP)

( * ) Notice: Subject to any disclaimer, the term of this patent is extended or adjusted under 35 U.S.C. 154(b) by 252 days.

(21) Appl. No.: 09/969,659

(22) Filed: Oct. 4, 2001

(65) Prior Publication Data

US 2002/0040939 A1 Apr. 11, 2002

(30) Foreign Application Priority Data

Oct. 5, 2000 (JP) ..... 2000-306150
Dec. 28, 2000 (JP) ..... 2000-399972

(51) Int. Cl.[7] ..... F02M 47/02

(52) U.S. Cl. ..... 239/88; 239/96; 239/533.8; 239/533.9

(58) Field of Search ..... 239/90, 96, 88, 239/533.8, 533.9; 251/30.01, 129.1

(56) References Cited

U.S. PATENT DOCUMENTS 4,674,688 A * 6/1987 Kanesaka ..... 239/533.8
4,728,074 A * 3/1988 Igashira et al. ..... 251/57
5,429,309 A * 7/1995 Stockner ..... 239/533.8
5,522,545 A * 6/1996 Camplin et al. ..... 239/92
5,779,149 A 7/1998 Hayes, Jr.
5,820,033 A 10/1998 Cooke
5,823,429 A * 10/1998 Beck et al. ..... 239/5
5,875,764 A 3/1999 Kappel et al.
6,142,443 A 11/2000 Potschin et al.
6,155,532 A 12/2000 Heinz et al.
6,224,001 B1 5/2001 Cooke et al.
6,257,499 B1 * 7/2001 Sturman ..... 239/96
6,367,453 B1 * 4/2002 Igashira et al. ..... 123/467

FOREIGN PATENT DOCUMENTS

DE 19844996 A1 4/2000
EP 0816670 A1 1/1998
EP 0909891 A1 4/1999
JP 11-166653 6/1999
JP 11-351098 12/1999

* cited by examiner

*Primary Examiner*—Michael Mar
*Assistant Examiner*—Thach H Bui
(74) *Attorney, Agent, or Firm*—Nixon & Vanderhye PC

(57) ABSTRACT

A fuel injector is provided which is designed to suppress unwanted vibrations of a nozzle needle-actuating piston, thereby avoiding the injection of an excess quantity of fuel. The fuel injector comprises an actuator and a displacement amplifying chamber filled with fluid to which a large-diameter piston and a small-diameter piston working as the nozzle needle-actuating piston are exposed. The displacement amplifying chamber works to amplify and transmit displacement of the large-diameter piston by the actuator to the small-diameter piston. The fuel injector also includes a stopper which restricts movement of the small-diameter piston toward the displacement amplifying chamber to a given range, thereby suppressing the unwanted vibrations of the small-diameter piston.

4 Claims, 9 Drawing Sheets

STRUCTURE OF FUEL INJECTOR FOR AVOIDING INJECTION OF EXCESS QUANTITY OF FUEL

BACKGROUND OF THE INVENTION

1. Technical Field of the Invention

The present invention relates generally to a fuel injector for internal combustion engines, and more particularly to an improved structure of a fuel injector designed to suppress unwanted vibrations of a nozzle needle-actuating piston for avoiding injection of an excess quantity of fuel.

2. Background Art

Hydraulic fuel injectors equipped with a piezoelectric valve actuator are used in internal combustion diesel engines of automotive vehicles. Such a fuel injector includes a large-diameter piston moved by the expansion and contraction of the piezoelectric valve actuator, a pressure chamber filled with hydraulic fluid, and a small-diameter piston which are arranged in alignment with each other. The movement of the large-diameter piston causes the hydraulic fluid in the pressure chamber to change in pressure which moves the small-diameter piston. The small-diameter piston then actuates a control valve.

When it is required to emit a fuel spray, the piezoelectric valve actuator is energized and expands to increase the hydraulic pressure in the pressure chamber through the large-diameter piston. This causes the expansion of the piezoelectric valve actuator to be amplified hydraulically and transmitted to the small-diameter piston. The small-diameter piston then moves downward and opens the control valve. When the control valve is opened, it will cause the pressure in a back pressure chamber to drop, thereby lifting up a nozzle needle to initiate fuel injection. Contracting the piezoelectric valve actuator will cause the small-diameter piston to move upward, thereby closing the control valve to terminate the fuel injection.

The above type of fuel injector, however, has the drawback in that during the contraction of the piezoelectric valve actuator, the control valve may be re-opened to inject an excess fuel into the engine undesirably. This is because the small-diameter piston overshoots due to its inertia when lifted upward and then moves downward as a reaction to open the control valve again. The small-diameter piston is exposed at its end to the pressure chamber and thus continues to oscillate for a relative long period of time. The amplitude of the oscillation increases and decreases cyclically as a function of width of an actuator-energizing pulse signal inputted to the piezoelectric valve actuator, thereby resulting in a change in quantity of fuel injected into the engine. Specifically, the quantity of fuel injected which is changed in proportion to the width of the actuator-energizing pulse signal changes undesirably due to the oscillation of the small-diameter piston.

SUMMARY OF THE INVENTION

It is therefore a principal object of the invention to avoid the disadvantages of the prior art.

It is another object of the invention to provide an improved structure of a fuel injector which is designed to minimize unwanted vibrations of a nozzle needle-actuating piston for avoiding injection of an excess quantity of fuel.

According to one aspect of the invention, there is provided a fuel injector which comprises: (a) a housing; (b) a control valve disposed movably within the housing to displace a needle for emitting a fuel spray; (c) a large-diameter piston disposed slidabley within the housing; (d) a small-diameter piston disposed slidably within the housing to move the control valve; (e) a displacement amplifying chamber filled with fluid to which the large-diameter piston and the small-diameter piston are exposed, the displacement amplifying chamber working to amplify and transmit displacement of the large-diameter piston to the small-diameter piston; (f) an actuator working to displace the large-diameter piston; and (g) a stopper restricting movement of the small-diameter piston toward the displacement amplifying chamber.

In the preferred mode of the invention, a damper is disposed within the displacement amplifying chamber to suppress vibrations of the small-diameter piston.

The damper is implemented by a hole formed in a ring plate secured or fitted slidably within the displacement amplifying chamber.

The stopper is implemented by a ring plate which is secured in the displacement amplifying chamber with a surface opposed to an end of the small-diameter piston through a given gap.

The housing has formed therein a first cylindrical chamber within which the large-diameter piston is disposed and a second cylindrical chamber within which the small-diameter piston is disposed. The first cylindrical chamber communicates with the second cylindrical chamber through the displacement amplifying chamber. The second cylindrical chamber extends eccentrically to a longitudinal center line of the first cylindrical chamber to define a surface at a junction of the first and second cylindrical chambers which is exposed to the second cylindrical chamber and works as the stopper.

According to the second aspect of the invention, there is provided a fuel injector which comprises: (a) a housing; (b) a control valve disposed movably within the housing to displace a needle for emitting a fuel spray; (c) a large-diameter piston disposed slidabley within the housing; (d) a small-diameter piston disposed slidably within the housing to move the control valve; (e) a displacement amplifying chamber filled with fluid to which the large-diameter piston and the small-diameter piston are exposed, the displacement amplifying chamber working to amplify and transmit displacement of the large-diameter piston to the small-diameter piston; (f) an actuator working to displace the large-diameter piston; (g) a first cylindrical chamber formed in the housing within which the large-diameter piston is disposed; (h) a second cylindrical chamber formed in the housing within which the small-diameter piston is disposed, the second cylindrical chamber communicating with the first cylindrical chamber through the displacement amplifying chamber, a longitudinal center line of the second cylindrical chamber extending eccentrically to a longitudinal center line of the first cylindrical chamber. The small-diameter piston is arranged coaxially with the control valve on one side of the displacement amplifying chamber.

In the preferred mode of the invention, the actuator is implemented by one of a piezoelectric device and a magnetostrictor, the control valve being moved to control fluid pressure within a back pressure chamber to which an end of the needle is exposed for opening a spray hole. The large-diameter piston is arranged coaxially with the actuator on one side of the displacement amplifying chamber. The small-diameter piston is arranged coaxially with the control valve on the other side of the displacement amplifying chamber.

The longitudinal center line of the second cylindrical chamber is shifted a distance e from the longitudinal center line of the first cylindrical chamber. The distance e satisfies a relation of $2e>D-d$ where D is diameter of the large-diameter piston and d is diameter of the small-diameter piston.

The longitudinal center line of the second cylindrical chamber extends eccentrically to the longitudinal center line of the first cylindrical chamber to define a surface at a junction of the first and second cylindrical chambers which is exposed to the second cylindrical chamber and works as a stopper restricting movement of the small-diameter piston toward the displacement amplifying chamber.

According to the third aspect of the invention, there is provided a fuel injector which comprises: (a) a nozzle needle displaced to open a spray hole; (b) an actuator displacing the nozzle needle, the actuator having a longitudinal center line extending eccentrically to a longitudinal center line of the nozzle needle; and (c) a housing within which the actuator is disposed, the housing being clamped on an internal combustion engine at two points provided symmetrically with respect to a line extending perpendicular to the longitudinal center lines of the nozzle needle and the actuator.

In the preferred mode of the invention, the housing has formed therein a high-pressure passage through which fuel is supplied to the spray hole. The high-pressure passage has a longitudinal center line extending perpendicular to a common line to which the longitudinal center lines of the actuator and the nozzle needle extend perpendicular.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is a perspective view which shows a ring plate working as a stopper restricting movement of a small-diameter piston;

FIG. 5(*b*) is a view which shows an overlap of eccentric cylindrical chambers within which a large-diameter piston and a small-diameter piston are disposed;

FIG. 6(*b*) is a partially sectional view which shows a check valve when an insufficient amount of fuel is stored in a displacement amplifying chamber;

FIG. 7(*b*) is a view which shows an overlap of eccentric cylindrical chambers within which a large-diameter piston and a small-diameter piston are disposed;

DESCRIPTION OF THE PREFERRED EMBODIMENTS

Figure 1:
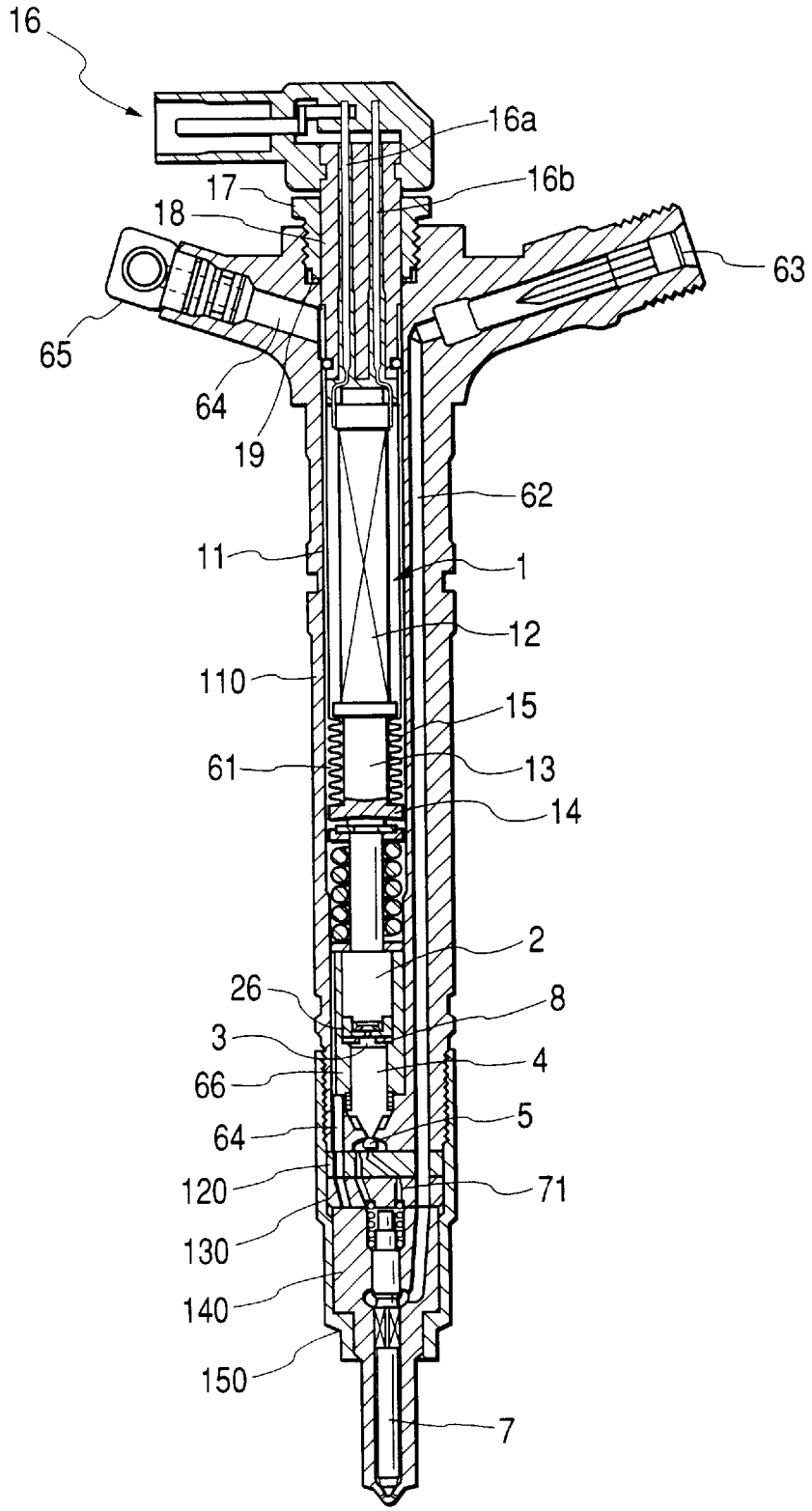
FIG. 1 is a vertical sectional view which shows a fuel injector according to the first embodiment of the invention.

Referring to the drawings, wherein like reference numbers refer to like parts in several views, particularly to FIG. 1, there is shown a fuel injector 100 according to the invention. The following discussion will refer to, as an example, a common rail fuel injection system in which the fuel injector 100 is provided for each cylinder of a diesel engine. The common rail fuel injection system includes a common rail which accumulates therein fuel supplied from a fuel tank elevated in pressure by a fuel pump installed in the engine. When it is required to inject the fuel into the engine, the fuel stored in the common rail under high pressure is supplied to the fuel injectors 100.

The fuel injector 100 includes, as shown in FIG. 1, a hollow cylindrical injector housing 110 in which a piezoelectric actuator 1 is disposed detachably, annular plates 120 and 130 in which fluid passages are formed, a nozzle body 140, and a retainer 150 having the annular plates 120 and 130 and the nozzle body 140 disposed therein in a liquid-tight form. The injector housing 110 has formed therein a high-pressure fuel passage 62 which extends longitudinally of the injector housing 110 and communicates with the common rail through a fuel inlet pipe 63. A fuel outlet pipe 65 is installed in an upper portion of the injector housing 110 opposite the fuel inlet pipe 63. The fuel flowing into a drain passage 64 is discharged from the fuel outlet pipe 65 to the fuel tank.

The injector housing 110 is made of a hollow cylinder which has a longitudinal hole or chamber 12 formed eccentrically to the longitudinal center line of the injector housing 110. The longitudinal chamber 12 extends parallel to the high-pressure fuel passage 62. The drain passage 64 extends downward through a gap between an inner wall of the longitudinal chamber 12 and the piezoelectric actuator 1. The piezoelectric actuator 1 consists essentially of a thin-walled metallic hollow cylindrical housing 11, a laminated piezoelectric device (also called a piezo stack) 12, a rod 13, a disc head 14, and a bellows 15. The disc head 14 is coupled with the rod 13 to be slidable. The bellows 15 extends from a lower end of the housing 11 to cover the rod 13 and connects with the periphery of the disk head 14. The vertical movement of the rod 13 causes the bellows 15 to expand or contract, thereby allowing the disk head 14 to move vertically. The bellows 15 provides a pre-load to the piezoelectric device 12.

The piezoelectric device 12 are coupled electrically to leads 16*a* and 16*b* of a connector 16 installed on an upper end of the housing 11. The piezoelectric device 12 is insulated electrically from the housing 11 through an insulator (not shown) and held by a retaining nut 17 fitted in the upper end of the housing 11. A ring shim 19 is disposed between a flange of a body 18 of the connector 16 and a shoulder formed on an upper inner wall of the longitudinal chamber 61 to seal a gap between the connector 16 and the longitudinal chamber 61. The shim 19 also serves as a spacer for adjusting the vertical position of the piezoelectric actuator 1 within the longitudinal chamber 61 to regulate the injection characteristics of the fuel injector 100 (e.g., the amount of fuel to be sprayed) finely.

Figure 2:
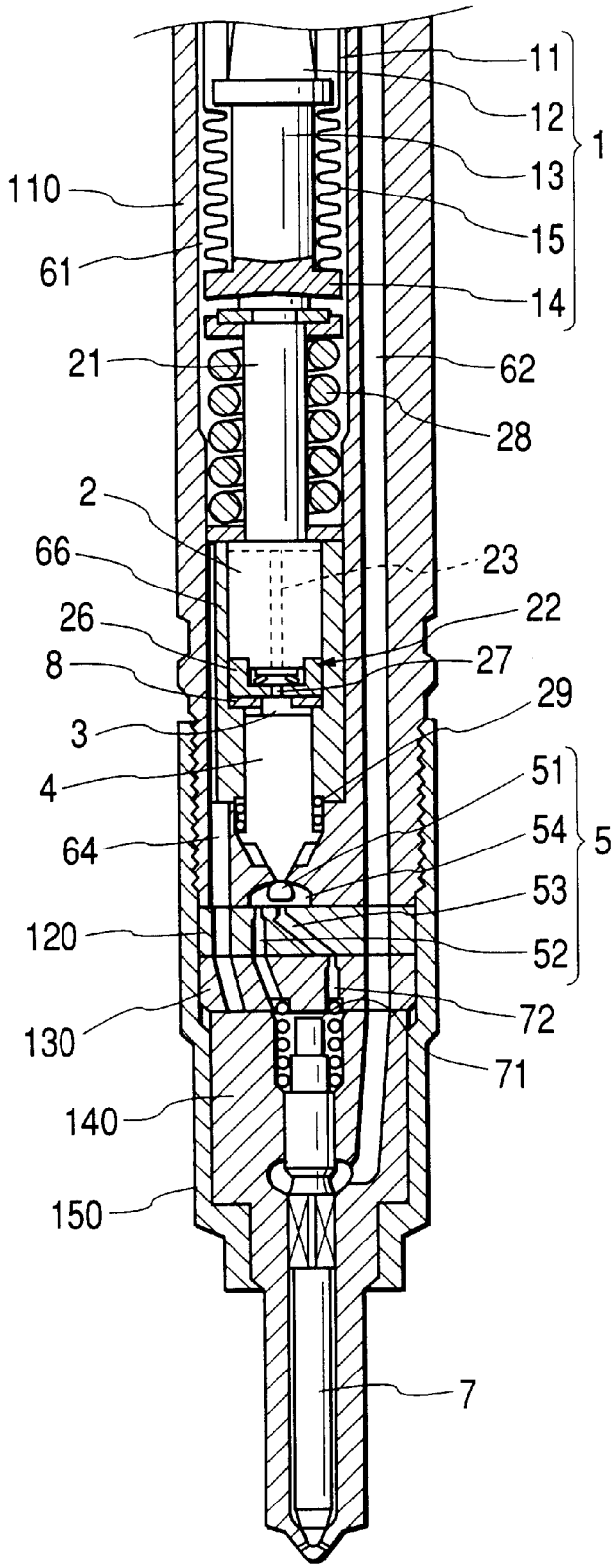
FIG. 2 is a partially enlarged sectional view which shows an internal structure of the fuel injector of FIG. 1.

The disk head 14 of the piezoelectric actuator 1 is, as clearly shown in FIG. 2, connected to a large-diameter piston 2 through a rod 21. The injector housing 110 has also disposed therein a small-diameter piston 4 which is coupled to the rod 21 through a displacement amplifying chamber 3 in alignment. The small-diameter piston 4 works to move a valve member 51 of a three-way valve 51. The large-diameter piston 2 and the small-diameter piston 4 are disposed slidably within large-diameter and small-diameter longitudinal chambers formed in a cylinder 66 fitted within the injector housing 110 and oriented in alignment with each other through the displacement amplifying chamber 3 filled with the fuel. The displacement amplifying chamber 3 works to transmit the longitudinal displacement of the large-diameter piston 2 to the small-diameter piston 4. Specifically, the stroke of the large-diameter piston 4 (i.e., the vertical movement of the piezoelectric device 12) is amplified through the fuel within the displacement amplifying chamber 3 as a function of a difference in diameter between the large-diameter piston 4 and the small-diameter piston 2 and transmitted to the small-diameter piston 2. Note that the three-way valve 51 has a known structure, and explanation thereof in detail will be omitted here.

A check valve 22 is disposed beneath the large-diameter piston 2. The check valve 22, as clearly shown in FIG. 3(*a*), consists of a valve plate 24, a conical spring 25, and an annular holder 26. The valve plate 24 works to open or close a low-pressure passage 23 formed in the large-diameter piston 2 leading to a drain passage 64 and is urged by the conical spring 25 against the end of the large-diameter piston 2 at all times. The holder 26 is of a cup-shape and secured at the periphery thereof on the periphery of the end of the large-diameter piston 2. The holder 26 has formed in the center thereof a hole 27 which establishes communication between a chamber in the holder 26 and the displacement amplifying chamber 3. A drop in pressure in the displacement amplifying chamber 3 due to, for example, fuel leakage will cause the valve plate 24 to move downward, as viewed in FIG. 3(*a*), against the spring pressure produced by the conical spring 25, so that the fuel flows from the low-pressure passage 23 into the displacement amplifying chamber 3, thereby avoiding the production of bubbles in the displacement amplifying chamber 3. The large-diameter piston 2 is, as viewed in FIG. 2, urged by a coil spring 28 disposed around the rod 21 toward the piezoelectric actuator 1, while the small-diameter piston 4 is urged by a coil spring 29 disposed therearound into constant engagement with the valve member 51.

The three-way valve 5 works as a control valve which establishes or blocks communication between a fluid passage 52 leading to a back pressure chamber 71 formed behind an end of a nozzle needle 7 and a high-pressure passage 53 or a low-pressure passage 54 to thereby control the pressure in the back pressure chamber 71. The high-pressure passage 53 communicates with the high-pressure fuel passage 62. The low-pressure passage 54 communicates with the drain passage 64. When the piezoelectric actuator 1 is energized by a pulse signal so that it expands, it will cause the large-diameter piston 2 to push the small-diameter piston 4 through the fuel in the displacement amplifying chamber 3, so that the valve plate 51 is moved downward to open the low-pressure passage 54. When the low-pressure passage 54 is opened, the fuel in the back pressure chamber 71 flows into the drain passage 64 through the three-way valve 64, thereby lifting up the nozzle needle 7 to initiate the fuel injection. When deenergized, the piezoelectric actuator 1 contracts to move the small-diameter piston 4 upward through the large-diameter piston 2. This causes the valve plate 51 to be lifted up by the pressure of the fuel in the high-pressure passage 53 to open the high-pressure passage 53, so that the fuel flows from the high-pressure fuel passage 62 into the back pressure chamber 71, thereby moving the nozzle needle 7 downward.

The plate 130 has formed therein a passage 72 that is a high-pressure passage which communicates the high-pressure fuel passage 62 and the back pressure chamber 71 directly without passing through the three-way valve 5 and leads to the high-pressure passage 53 through an orifice. Specifically, the high-pressure fuel passage 62 communicates with the back pressure chamber 71 through the passage 72 at all times, thereby avoiding a quick drop in pressure in the back pressure chamber 71 for lifting up the nozzle needle 7 slowly when the fuel injection is initiated and facilitating a quick elevation in pressure in the back pressure chamber 71 for moving the nozzle needle 7 quickly when the fuel injection is terminated.

Figure 3A:
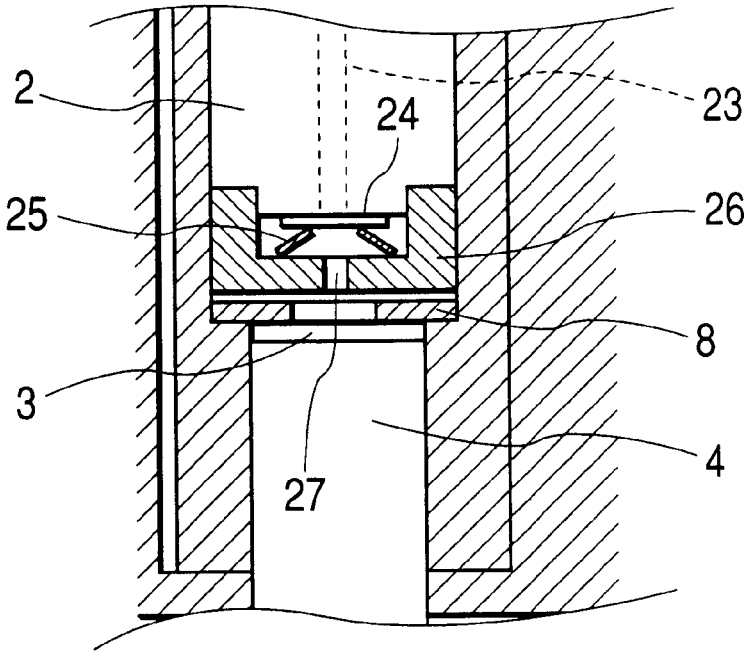
FIG. 3(*a*) is a partially sectional view which shows a check valve disposed in a chamber within which a large-diameter piston is disposed.
Figure 3B:
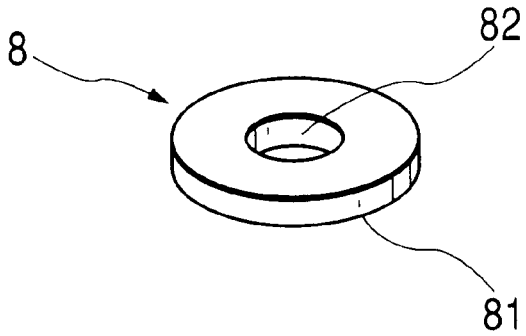

A ring plate 8, as clearly shown in FIG. 3(*b*), is fitted within the cylinder 66 and rests on a shoulder on an inner wall of the cylinder 66. The ring plate 8 has a given thickness and faces the end of the small-diameter piston 4 through a given gap (i.e., the displacement amplifying chamber 3). Specifically, the ring plate 81 has, as shown in FIG. 3(*b*), the stopper surface 81 on which the small-diameter piston 4 hits when lifted upward, thereby defining a range of displacement of the small-diameter piston 4 which does not induce unwanted vibrations of the small-diameter piston 4. The ring plate 81 has formed in the center thereof a hole 82 which is smaller in diameter than the small-diameter piston 4 and works as a damper to suppress vibrations of the small-diameter piston 4 through the flow of fuel therethrough. The ring plate 81 is located at a given interval away from the end of the large-diameter piston 2 without interfering the motion of the large-diameter piston 2.

In a case where the ring plate 81 is not used, after the large-diameter piston 2 and the small-diameter piston 4 are lifted up fully, the small-diameter piston 2 is free to move within the cylinder 66 and thus oscillates, so that it may move downward to open the three-way valve 5 again. The use of the ring plate 81 minimizes an undesirable upward movement of the small-diameter piston 4 and avoids oscillations thereof at unwanted greater amplitudes. This prevents the three-way valve 5 from re-opening by the oscillations of the small-diameter piston 4, thus avoiding a reduction in pressure within the back pressure chamber 71 which causes the nozzle needle 7 to move upward immediately after moving downward and a temporal stop of movement of the small-diameter piston 4, thereby avoiding the injection of excess fuel.

Figure 4:
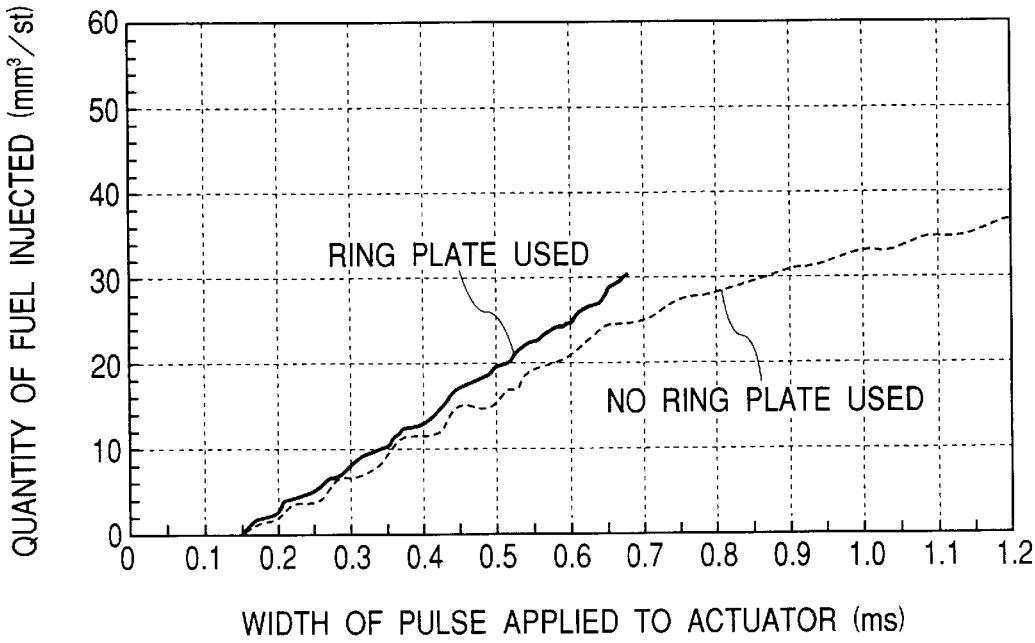
FIG. 4 is a graph which shows relations between the quantity of fuel injected and the width of a pulse signal applied to a piezoelectric actuator in cases where the ring plate of FIG. 3(*b*) is used and not used.

FIG. 4 illustrates the quantity of fuel sprayed from the fuel injector 100 for cases where the ring plate 8 is used and not used. It is advisable that the quantity of fuel injected, as expressed by the ordinate axis, increase in proportion to the width of a pulse signal, as expressed by the abscissa axis, applied to the piezoelectric actuator 1. However, when the ring plate 8 is not used, the oscillations of the small-diameter piston 4 may cause the three-way valve 5 to open undesirably to emit a fuel spray. The amplitude of oscillation of the small-diameter piston 4 increases and decreases cyclically with an increase in width of a pulse applied to the piezoelectric actuator 1 in relation to the mass and spring coefficients of peripheral parts. Alternatively, when the ring plate 8 is used, the ring plate 8 works to suppress the vibrations of the small-diameter piston 4, thereby causing the quantity of fuel injected to increase in proportion to an increase in width of a pulse signal applied to the piezoelectric actuator 1, which minimizes a variation in quantity of fuel injected, especially when it is required for the fuel injector 100 to emit a fuel spray finely.

Figure 5A:
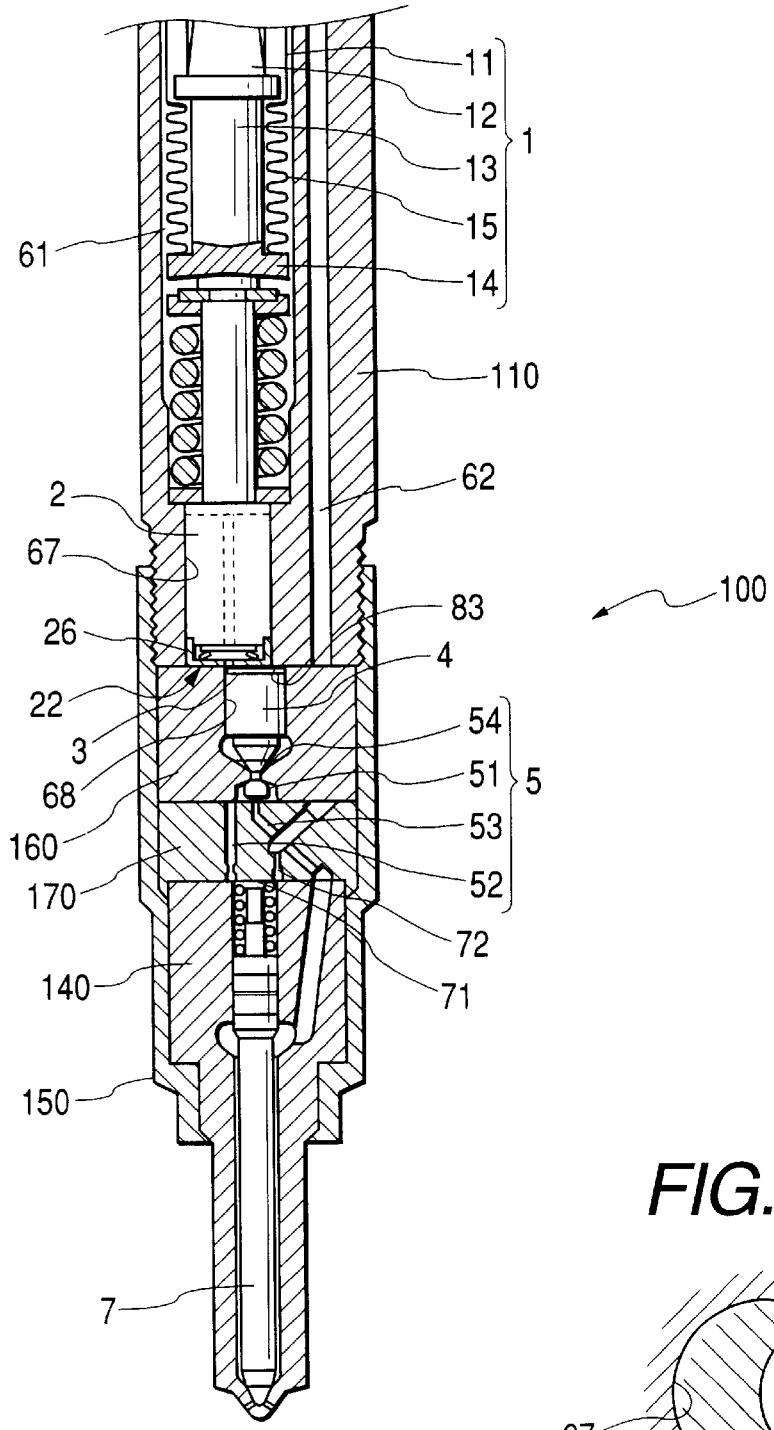
FIG. 5(*a*) is a partially enlarged sectional view which shows an internal structure of a fuel injector according to the second embodiment of the invention.
Figure 5B:
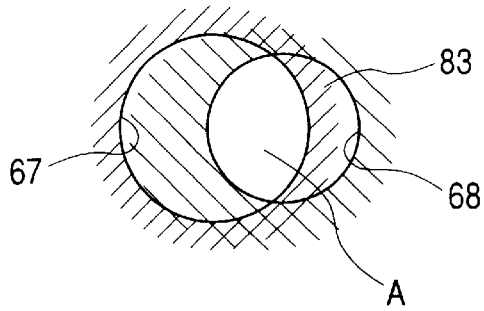

FIGS. 5(*a*) and 5(*b*) show the fuel injector 100 according to the second embodiment of the invention. The same reference numbers as employed in the first embodiment refer to the same parts, and explanation thereof in detail will be omitted here.

The housing 110 has a first cylindrical chamber 67 formed therein coaxially with the longitudinal chamber 61 within which the large-diameter piston 2 is disposed slidably. A cylindrical block 160 is disposed in alignment with the housing 110 and has formed therein a second cylindrical chamber 68 within which the small-diameter piston 4 is disposed slidably. The first cylindrical chamber 67 extends in alignment of the longitudinal center line thereof with that of the housing 110 and eccentrically to the second cylindrical chamber 68 in communication therewith. The displacement amplifying chamber 3 is defined in a junction of the first and second cylindrical chambers 67 and 68.

The longitudinal center line of the first cylindrical chamber 67 is shifted, as clearly shown in FIG. 5(*b*), from that of the second cylindrical chamber 68 so that a sectional area, as indicated by A, of an overlap of the first and second cylindrical chambers 67 and 68 may be smaller than a sectional area of the second cylindrical chamber 68, thereby defining a crescent-shaped surface 83 on an end of the housing 110 around the periphery of the first cylindrical chamber 67 which works, like the ring plate 8 of the first embodiment, as a stopper on which the small-diameter piston 4 hits when lifted upward.

The holder 26 of the check valve 22 is not secured on the end of the large-diameter piston 2 and placed in a lower end portion of the first cylindrical chamber 67 (i.e., the displacement amplifying chamber 3) so that the holder 26 may not be lifted up following the upward movement of the large-diameter piston 2. Thus, when the small-diameter piston 4 displaces, it will cause the fuel to flow into the hole 27 formed in the holder 26, thereby suppressing the vibrations of the small-diameter piston 4. The sectional area of the overlap of the first and second cylindrical chambers 67 and 68 is, as described above, smaller than that of the second cylindrical chamber 68, which works as a damper suppressing the vibrations of the fuel (i.e., the vibrations of the small-diameter piston 4) when flowing therethrough.

Figure 6A:
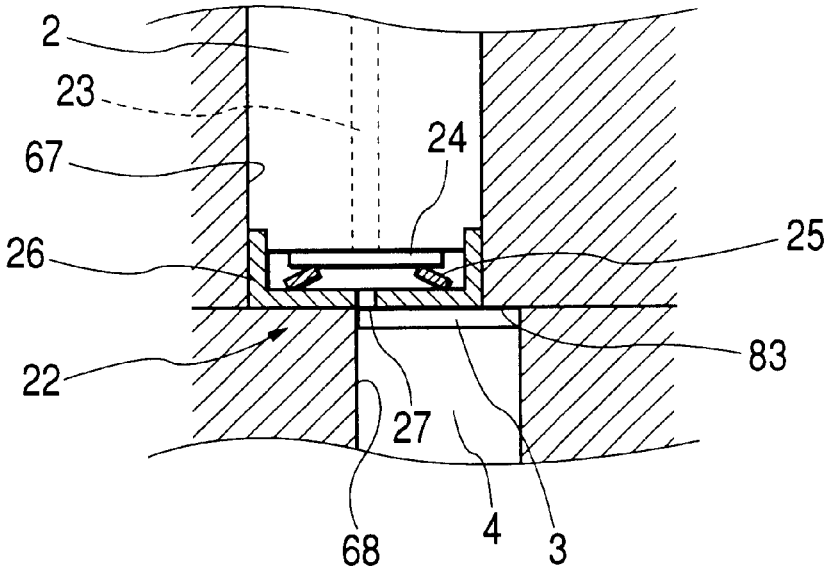
FIG. 6(*a*) is a partially sectional view which shows a check valve when a sufficient amount of fuel is stored in a displacement amplifying chamber.
Figure 6B:
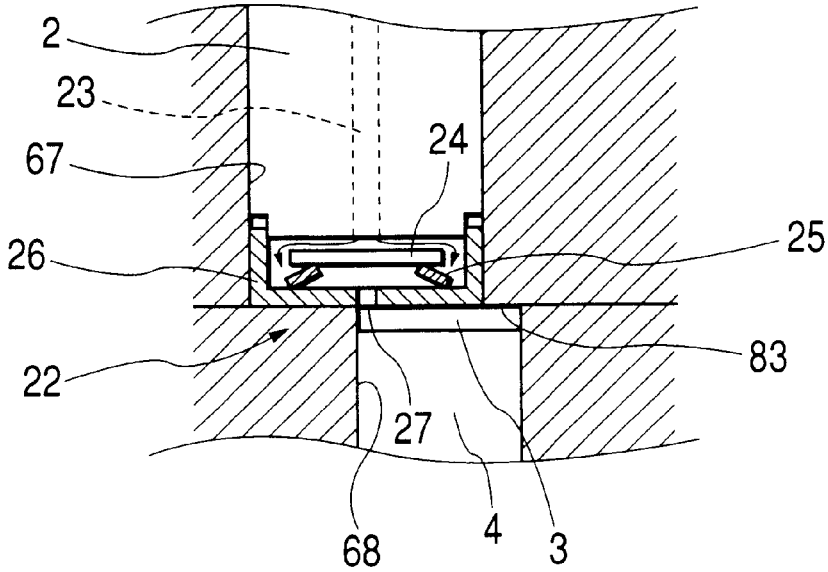

The check valve 22 works like the one in the first embodiment. Specifically, when a sufficient amount of fuel is, as shown in FIG. 6(*a*), stored in the displacement amplifying chamber 3, the pressure urging the valve plate 24 into constant contact with the end of the large-diameter piston 2 (i.e., the sum of the spring pressure of the conical spring 25 and the fuel pressure in the displacement amplifying chamber 3) is greater than the pressure in the low-pressure passage 23. Thus, even when the large-diameter piston 2 is lifted up, the valve plate 24 is kept closing the low-pressure passage 23. Alternatively, when the amount of fuel stored in the displacement amplifying chamber 3 is too small to keep the valve plate 24 closing the low-pressure passage 23, the upward movement of the large-diameter piston 3, as shown in FIG. 6(*b*), causes the valve plate 24 to move out of engagement with the end of the large-diameter piston 2, thereby opening the low-pressure passage 23, so that the fuel flows from the low-pressure passage 23 into the displacement amplifying chamber 3, thereby keeping the pressure in the displacement amplifying chamber 3 at a desired level. The first cylindrical chamber 67 communicates with the second cylindrical chamber 68 through a gap between the outer wall of the holder 26 and the inner wall of the first cylindrical chamber 67 and the central hole 27 in the holder 26.

As apparent from the above discussion, the second cylindrical chamber 68 is shifted laterally from the first cylindrical chamber 67 so as to define the stopper surface 83 which works to suppress undesirable motion of the small-diameter piston 4. This eliminates the need for installing a separate stopper in the housing 110, thus avoiding an increase in manufacturing costs of the fuel injector 100. The small-diameter piston 4 is not installed in the longitudinal chamber 61 and in the cylindrical block 160, thereby decreasing the length of the first cylindrical chamber 67 which is difficult to machine because of the eccentricity thereof.

Instead of the annular plates 120 and 130 in the first embodiment, only an annular plate 170 is disposed between the cylindrical block 160 and the nozzle body 140. The high-pressure fuel passage 62 is, thus, different in geometry from the one in the first embodiment.

Figure 7A:
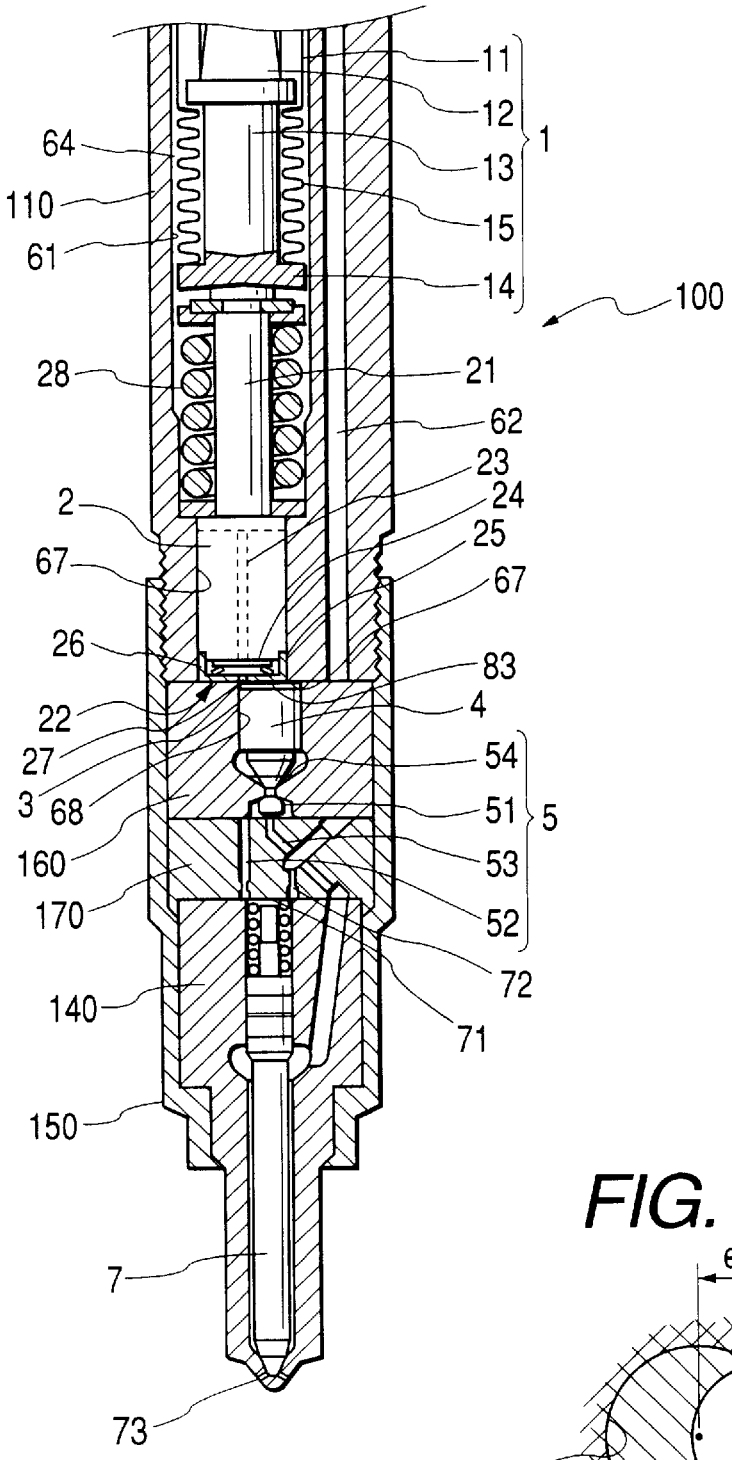
FIG. 7(*a*) is a partially enlarged sectional view which shows an internal structure of a fuel injector according to the third embodiment of the invention.
Figure 7B:
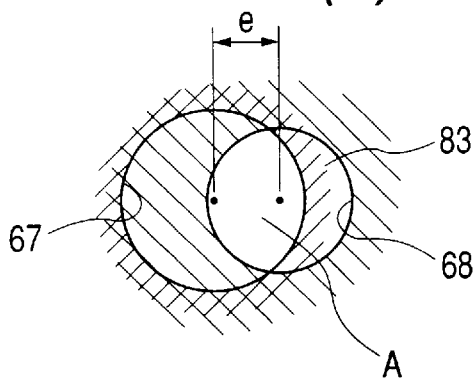

FIGS. 7(*a*) and 7(*b*) show the fuel injector 100 according to the third embodiment of the invention.

The three-way valve 5 is located coaxially with the small-diameter piston 4. Specifically, a longitudinal center line of the small-diameter piston 4 is in alignment with the center of the valve member 51 of the three-way valve 5 (i.e., a line along which the valve member 51 moves). The three-way valve 5 works as a control valve which establishes or blocks communication between the fluid passage 52 leading to the back pressure chamber 71 formed behind the back end of the nozzle needle 7 and the high-pressure passage 53 leading to the high-pressure passage 62 or the low-pressure passage 54 leading to the drain passage 64 to thereby control the pressure in the back pressure chamber 71. The nozzle needle 7 is disposed slidabley within a chamber formed in the nozzle body 140 which extends along a longitudinal center line of the nozzle body 140 and works to open and close spray holes 73 selectively.

The first cylindrical chamber 67 and the second cylindrical chamber 68 are, like the second embodiment, not co-axial. If the distance between the centers of sectional areas of the first and second cylindrical chambers 67 and 68 is, as shown in FIG. 7(*b*), defined as e, and diameters of the large-diameter piston 2 and the small-diameter piston 4 are defined as D and d, respectively, a relation of $2e>D-d$ is preferably satisfied. This defines the crescent-shaped surface 83 on the end of the housing 110 around the periphery of the first cylindrical chamber 67 which works as a stopper on which the small-diameter piston 4 hits when lifted upward, thereby avoiding undesirable movement of the small-diameter piston 4 causing unwanted fuel injection. The sectional area A of the overlap of the first and second cylindrical chambers 67 and 68 is smaller than that of the second cylindrical chamber 68 and thus works as a damper suppressing the vibrations of the fuel (i.e., the vibrations of the small-diameter piston 4) when the fuel flows therethrough.

Figure 9:
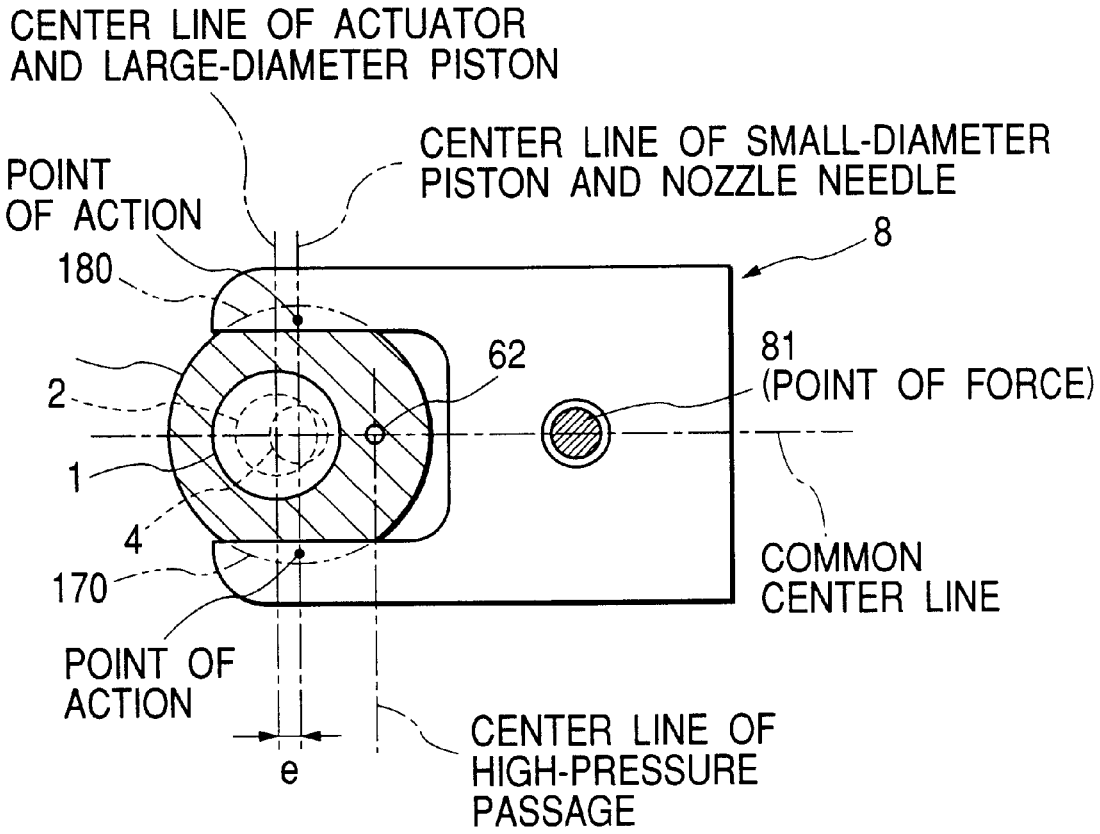
FIG. 9 is a plan view, as taken along the line A—A in FIG. 8, which shows a clamper retaining a fuel injector in an engine block.

The piezoelectric actuator 1 is disposed within the housing 110 eccentrically to the nozzle needle 7, thereby providing an area sufficient to form the high-pressure passage 62 adjacent the piezoelectric actuator 1. It is advisable that the high pressure passage 62, as shown in FIG. 9, be opposed to the longitudinal center line of the piezoelectric actuator 1 across the longitudinal center line of the nozzle needle 7 and that the longitudinal center lines of the high-pressure passage 62, the piezoelectric actuator 1 (i.e., the large-diameter piston 2), and the nozzle needle 7 (i.e., the small-diameter piston 4) intersect a common center line a, thereby allowing a peripheral wall of the high-pressure passage 62 to be thick enough to ensure a desired strength of the periphery wall of the high-pressure passage 62.

The piezoelectric actuator 1, the rod 21, and the large-diameter piston 2 are co-axial. The small-diameter piston 4, the valve member 51 of the three-way valve 5, and the nozzle needle 7 are co-axial. This avoids the twist of the small-diameter piston 4 caused by the moment acting on the small-diameter piston 4 resulting from the reaction of the valve member 51 when moved, thus ensuring a steady fuel injection operation. The small-diameter piston 4 is co-axial with the nozzle needle 7 and disposed within the cylindrical block 160 which is separate from the housing 110, thereby facilitating ease of machining the eccentric chambers 61 and 67.

Figure 8:
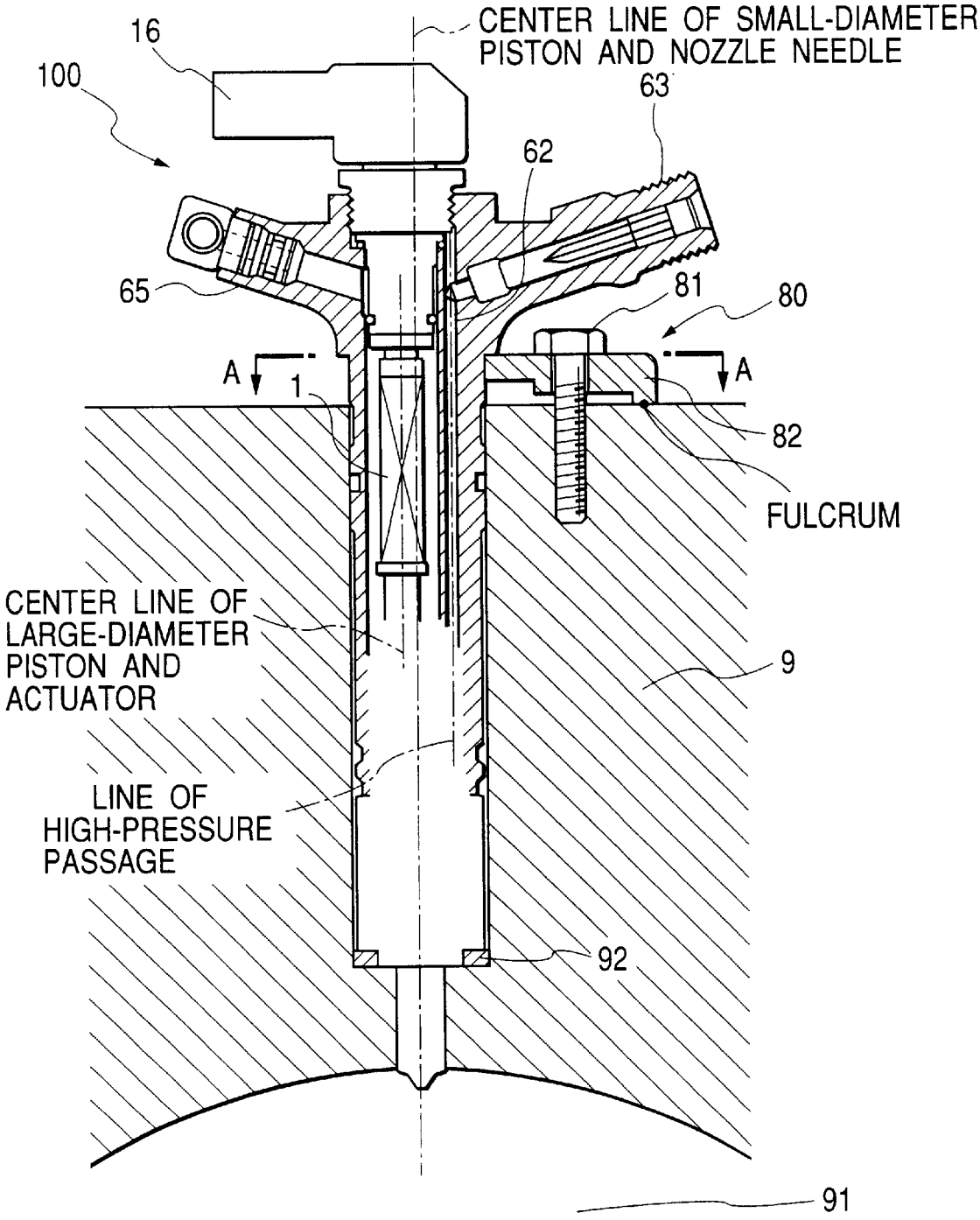
FIG. 8 is a sectional view which shows a fuel injector mounted in an engine block.

The fuel injector 100 is installed, as shown in FIG. 8, in an engine head 9 using a clamp 80. The clamp 80, as clearly shown in FIG. 9, has a pair of tines. The tines are fitted in parallel grooves 170 and 180 formed in an outer wall of the housing 110 to hold the housing 110. The clamp 80 is attached to the engine head 9 through a bolt 81 in contact of the bottom of a vertical wall 82 with the surface of the engine head 9. The vertical wall 82 extends downward from the end of the clamp 80. The bolt 81 is so located that the longitudinal center line thereof intersects the common center line a in FIG. 9. The retainer 150 of the fuel injector 100 is disposed in contact with the bottom of a hole formed in the engine head 9 through a gasket 92. The head of the nozzle body 140 is exposed to a combustion chamber 91.

The clamp 80 works as a lever which multiplies the force clamping the fuel injector 100. Specifically, the clamp 80 is pivoted about a fixed point (i.e., fulcrum) at which the bottom of the vertical wall 82 rests on the surface of the engine block 9. The force produced by fastening the bolt 81 is multiplied and exerted on the grooves 170 and 180 of the housing 110. The grooves 170 and 180 are so formed in the peripheral wall of the housing 110 as to extend parallel to each other symmetrically with respect to the common center line a and perpendicular to the longitudinal center lines of the large-diameter piston 2, the small-diameter piston 4, and the high-pressure passage 62. This causes two points of action to be defined in the grooves 170 and 180 at which the clamping force acts uniformly, thereby decreasing the deformation of the piezoelectric actuator 1 even if it has a relatively small flexural strength.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims. For example, the three-way valve 5 is used to open and close the spray hole formed in the head of the nozzle body 140, however, the invention is not limited to the same. Another known mechanism may be used to open and close the spray hole. Further, the actuator 1 is implemented by a piezoelectric device, however, another element such as a magnetostrictor may be used as long as it is so constructed as to expand and contract in response to input of an electric signal.

What is claimed is:

1. A fuel injector comprising:

a housing;

a control valve disposed movably within said housing to displace a needle for emitting a fuel spray;

a large-diameter piston disposed slidably within said housing;

a small-diameter piston disposed slidably within said housing to move said control valve;

a displacement amplifying chamber filled with fluid to which said large-diameter piston and said small-diameter piston are exposed, said displacement amplifying chamber working to amplify and transmit displacement of said large-diameter piston to said small-diameter piston;

an actuator working to displace said large-diameter piston;

a stopper restricting movement of said small-diameter piston toward said displacement amplifying chamber; and a damper disposed within said displacement amplifying chamber to suppress vibrations of said small-diameter piston, wherein said damper is implemented by a hole formed in a ring plate secured or fitted slidably within said displacement amplifying chamber.

2. A fuel injector comprising:

a housing;

a control valve disposed movably within said housing to displace a needle for emitting a fuel spray;

a large-diameter piston disposed slidably within said housing;

a small-diameter piston disposed slidably within said housing to move said control valve;

a displacement amplifying chamber filled with fluid to which said large-diameter piston and said small-diameter piston are exposed, said displacement amplifying chamber working to amplify and transmit displacement of said large-diameter piston to said small-diameter piston;

an actuator working to displace said large-diameter piston; and a stopper restricting movement of said small-diameter piston toward said displacement amplifying chamber, wherein said stopper is implemented by a ring plate which is secured in said displacement amplifying chamber with a surface opposed to an end of said small-diameter piston through a given gap, said ring plate having formed therein a hole working as a damper suppressing vibrations of said small-diameter piston.

3. A fuel injector comprising:

a housing;

a control valve disposed movably within said housing to displace a needle for emitting a fuel spray;

a large-diameter piston disposed slidably within said housing;

a small-diameter piston disposed slidably within said housing to move said control valve;

a displacement amplifying chamber filled with fluid to which said large-diameter piston and said small-diameter piston are exposed, said displacement amplifying chamber working to amplify and transmit displacement of said large-diameter piston to said small-diameter piston, the small-diameter piston being arranged coaxially with said control valve on one side of said displacement amplifying chamber;

an actuator working to displace said large-diameter piston;

a first cylindrical chamber formed in said housing within which said large-diameter piston is disposed;

a second cylindrical chamber formed in said housing within which said small-diameter piston is disposed, said second cylindrical chamber communicating with said first cylindrical chamber through said displacement amplifying chamber, a longitudinal center line of said second cylindrical chamber extending eccentrically to a longitudinal center line of said first cylindrical chamber, wherein the longitudinal center line of said second cylindrical chamber is shifted a distance e from the longitudinal center line of said first cylindrical chamber, the distance e satisfying a relation of $2e > D-d$ where D is diameter of said large-diameter piston and d is diameter of said small-diameter piston.

4. A fuel injector as set forth in claim 3, wherein said actuator is implemented by one of a piezoelectric device and a magnetostrictor, said control valve being moved to control fluid pressure within a back pressure chamber to which an end of the needle is exposed for opening a spray hole, said large-diameter piston being arranged coaxially with said actuator on one side of said displacement amplifying chamber, the small-diameter piston being arranged coaxially with said control valve on the other side of said displacement amplifying chamber.

* * * * *